US006136153A

United States Patent [19]

Rokman et al.

[11] Patent Number: 6,136,153

[45] Date of Patent: Oct. 24, 2000

[54] FOAM PROCESS WEB FORMATION USING PRESSURE REMOVAL OF FLUID

[75] Inventors: Kay Rokman; Juhani Jansson, both of Karhula; Eino Laine, Kyminlinna, all of Finland

[73] Assignee: Ahlstrom Glassfibre Oy, Karhula, Finland

[21] Appl. No.: 09/255,755

[22] Filed: Feb. 23, 1999

[51] Int. Cl.[7] ..... D21F 1/00

[52] U.S. Cl. ..... 162/336; 162/343; 162/101; 162/289; 162/360.2; 162/298; 162/123

[58] Field of Search ..... 162/336, 343, 162/101, 360.2, 363, 300, 301, 303, 259, 298, 289, 315, 102, 168.1, 183, 212, 123, 124, 127, 129

[56] References Cited

U.S. PATENT DOCUMENTS

| | | |
|---|---|---|
| 3,598,696 | 8/1971 | Beck . |
| 3,853,694 | 12/1974 | Parker . |
| 3,922,191 | 11/1975 | Witt et al. . |
| 3,923,593 | 12/1975 | Verseput . |
| 4,086,130 | 4/1978 | Justus . |
| 4,124,441 | 11/1978 | Nykopp . |
| 4,443,297 | 4/1984 | Cheshire et al. . |
| 4,445,974 | 5/1984 | Stenberg . |
| 4,764,253 | 8/1988 | Cheshire et al. . |
| 4,803,955 | 2/1989 | Koski . |
| 5,203,967 | 4/1993 | Bando et al. . |
| 5,489,365 | 2/1996 | Wahlstrom . |
| 5,795,442 | 8/1998 | Boyd et al. . |
| 5,851,356 | 12/1998 | Banning et al. . |
| 5,904,809 | 5/1999 | Rokman et al. . |
| 6,019,871 | 2/2000 | Rokman ..... 162/101 |

*Primary Examiner*—Stanley S. Silverman
*Assistant Examiner*—Mark Halpern
*Attorney, Agent, or Firm*—Nixon & Vanderhye P.C.

[57] ABSTRACT

In an assembly and method for producing a non-woven web of fibrous material utilizing the foam process, an edge seal for the former is provided which can include the introduction of substantially free foam into the edge seal for providing lubrication and to prevent leakage of fiber-containing slurry from the former. Web formation is primarily due to a mechanical force provided by nip rolls, although suction tables and other suction devices are also provided to carry away foam removed by the nip rolls, or at other stages. The foam/fiber slurry may be formed by introducing the foam tangentially into a tank at a plurality of locations to establish a vortex, and by introducing fiber into the top of the tank, and pumping from the bottom of the tank. The foam/fiber slurry may be introduced using a structure that can be reciprocated toward and away from the inlet of the former, and which has a number of changes defined by pivoted or flexible plates to form distinct strata at least at the start of web formation.

29 Claims, 6 Drawing Sheets

FOAM PROCESS WEB FORMATION USING PRESSURE REMOVAL OF FLUID

BACKGROUND AND SUMMARY OF THE INVENTION

The invention relates to a process and equipment for the foam process web formation, and is related to U.S. Pat. No. 5,904,809, the disclosure of which is incorporated by reference herein.

In many applications of the foam process, a relatively high level of suction, e.g., on the order of about 1.5 meters of water, is provided as the primary web formation mechanism. However, for some products, it is desirable to provide a mechanical force and mechanical energy for removing the foam from the slurry to form a non-woven web so that the mechanical action provides more than 50% (typically more than 90%) of the web formation force. Under such circumstances nip rollers or like mechanical elements may be provided and the suction force utilized is relatively small, on the order 100 centimeters or less, typically less than 50 centimeters, e.g. about 10 centimeters of water head. There are many other features—such as various end seals, edge seals, former components, foam forming apparatus and methods, and the like—which also may desirably be utilized in order to make a wide variety of different products. According to the present invention a wide variety of alternative constructions and procedures are provided which allow great flexibility in implementing the foam process and the production of a wide variety of desired products, enhancing the utilization of the foam process as described in the above mentioned copending applications.

According to the first aspect of the invention a former assembly for producing a non-woven web of fibrous material is provided comprising the following components: A foraminous element (i.e. "wire") on which a non-woven fibrous web may be formed moving in a first direction. A former through which the foraminous element moves in the first direction, the former including a first foam/fiber slurry introduction end and a second formed web withdrawing end. Means for introducing a foam/fiber slurry into the former first end so that the slurry contacts the wire. Means for removing foam from the slurry to effect formation of a web on the wire wherein the wire has side edges substantially parallel to the first direction. An edge seal for each of the side edges of the wire which allows some sideways movement of the wire, in a dimension substantially perpendicular to the first direction, but does not allow significant leakage of slurry from the former. And means for introducing substantially fiber free foam into the edge seal at at least some portions thereof for providing lubrication and to assist in preventing leakage of fiber-containing slurry from the former.

The means for introducing the foam/fiber slurry may comprise any conventional structure for that purpose, including any type of conduit, header, manifold, nozzle, or the like which is suitable for that purpose. The means for removing the foam from the slurry to effect formation of a web on the wire may comprise suction tables, suction rollers, or the like, but preferably include at least one set of nip rolls. For example, the former may comprise a first section adjacent the first end including a suction table, and a second section adjacent the second end and comprising at least one set of nip rollers. The means for introducing substantially fiber-free foam into the edge seal preferably introduces substantially fiber-free foam only into the second section of the edge seal, not the first section, and the foam introduction means may comprise any conventional structure for that purpose including all types of conduits, nozzles, headers, manifolds, or like fluidic elements. The edge seal comprises a first edge seal at the first section, a second edge seal at the second section, and the second section may comprise at least two pairs of nips rolls with a suction device between the two pairs of nip rolls for handling foam removed by the nip rollers. Typically, the suction table in the first section will have low suction, less than 100 centimeters water head, preferably less than 50 centimeters water head, e.g. about 10 centimeters water head. The nip rolls provide more than 50% of the energy for foam removal to effect web formation, typically more than 90%, or any percentage between 51%–90%.

The nip rolls may have side faces and the second edge seal may comprise a plastic plate adjacent each side edge of the wire and associated with the nip roll side edges, and having a space formed therebetween. The foam introducing means introduces substantially fiber-free foam into the spaces so that substantially fiber-free foam fills the spaces. At least one of the nip rolls may comprise a suction roll for carrying away foam removed by the nip rolls, and a suction device between sets of nip rolls, or after the second nip rolls, typically is provided comprising either a low or high suction device; in any event the totality of all of the suction devices provide less than 50% of the energy for web formation.

The first edge seal may comprise a channel shaped element having a pair of substantially parallel metal side plates spaced from each other by a crosspiece, the side plates having outer surfaces receiving a wire edge therebetween and spaced from the wire. Flexible material sealing elements, such as O-rings (in strip form) or the like, of elastomeric material, may be stationarily mounted to the former and engage the side plate outer surfaces to provide a seal therewith. More than one set of O-rings may be provided to insure positive sealing. Also, any conventional means (such as pneumatic cylinders, reciprocating electrical motors or associated mechanical components or the like) are provided for reciprocating the crosspiece in a dimension substantially perpendicular to the first direction so as to accommodate wires of different width, but so that the side plates continue to engage the flexible material seals. That is, the side plates have a length greater than the length of travel of the reciprocating means to insure continued sealing.

Typically also provided are means for carrying foam removed by the foam removing means away from the removing means (such as conduits, associated pumps such as centrifugal pumps, or the like) into a device for mixing the additional fibers to produce a foam-fiber slurry (or "new" foam may also be added to the foam-fiber slurry). The device for mixing the foam with additional fibers may comprise a tank having a top, bottom, and a plurality of tangential foam inlets for establishing at least one vortex in the tank; means for adding fiber through the top of the tank (any conventional conveying or injecting structure, or any other structure for performing that function); and a foam-fiber slurry pump connected to the bottom of the tank. While the pump is preferably centrifugal, other types of pumps may also be utilized.

The former may further comprise a pivotal metal plate past which the wire moves, the plate having a free end a roller seal adjacent the free end and engaging the wire, with a volume defined between the free end and the roller seal. Means are preferably provided for injecting substantially fiber-free foam into the volume between the free end and the roller seal under a pressure greater than in the former on the opposite side of the roller seal from the free end. The foam injecting means may comprise any conventional structure for that purpose such as conventional conduits, pumps, nozzles, manifolds, or like fluidic components.

The former also further may comprise a rubber or plastic end portion comprising or covering in the free end of the pivotal plate. A second metal plate spaced from the pivotal metal plate and having a free end, a second roller seal spaced from the free end and engaging the wire, and another rubber or plastic end portion comprising or covering the second plate free end may also be provided.

The assembly according to the invention may also comprise means for introducing at least two different strata into the former at the first end thereof, the first of the strata comprising a fiber/foam slurry having first properties, and a second strata comprising a fiber/foam slurry having second properties significantly different from the first properties, or any other material capable of incorporation into a web of fibrous material (such as Sugar Absorbent Polymer—SAP, or other powders or slurries for performing particular functions). The strata introducing means may comprise any suitable conventional structure for that purpose including conventional manifolds, conduits, nozzles, and like fluidic components.

The assembly may also comprise means for reciprocating the strata introducing means toward and away from the former first end which allows adaptation of the process to particular strata and other parameters. The strata introducing means may also comprise at least one metal plate having a pivoted end most remote from the former first end, and a free end closest to the former first end, the free end having no metal portion touching the wire. In fact the wire may comprise a first wire and the assembly may further comprise a second wire moving generally parallel to the first wire, with the strata introducing means comprising a second pivoted plate and means for introducing at least three strata in the former first end. The first and third strata are typically in contact with the first and second wires (and the first and third strata typically being fiber/foam slurries of substantially the same properties and consistencies, although they may be different), with the second strata between the first and third strata which is thereby precluded from directly contacting the wires. Under these circumstances the second strata typically will be SAP or like material that must be prevented from coming into direct contact with the wires. The means for removing the foam from the slurry comprises, only in part, suction tables cooperating with the first and second wires adjacent the first end of the former, the tables supplying a vacuum of less than 100 cm water head (typically less than 50 cm water head, typically about 10 cm water head) so as to only remove excess foam from the slurry. The nip rolls downstream of the suction tables apply the majority of the force necessary for forming the web from the slurry.

According to a second aspect of the invention a former assembly for producing a non-woven web of fibrous material is provided comprising the following components: A foraminous element on which a non-woven fibrous web may be formed moving in a first direction. A former through which the foraminous element moves in the first direction, the former including a first foam/fiber slurry introduction end and a second formed web withdrawing end. Means for introducing a foam/fiber slurry into the former first end so that the slurry contacts the wire. Means for removing foam from the slurry to effect formation of a web on the wire. And wherein the former further comprises a pivotal metal plate past which the wire moves, the plate having a free end and a roller seal adjacent said free end and engaging the wire, a volume defined between the free end and the roller seal; and means for injecting substantially fiber free foam into the volume between the free end and the roller seal under a pressure greater than the pressure in the former on the opposite side of the roller seal from the free end. The details of the former, and other components, may be as described above.

According to another aspect of the invention a former assembly for producing a non-woven web of fibrous material is provided comprising the following components: A foraminous element on which a non-woven fibrous web may be formed moving in a first direction. A former through which said foraminous element moves in the first direction, said former including a first foam/fiber slurry introduction end and a second formed web withdrawing end. Means for introducing a foam/fiber slurry into said former first end so that the slurry contacts the wire. Means for removing foam from the slurry to effect formation of a web on said wire. And, means for introducing at least two different strata into said former at said first end thereof, a first of said strata comprising a fiber/foam slurry having first properties, and a second of said strata comprising a fiber/foam slurry having second properties significantly different from said first properties, or another material capable of incorporation into a web of fibrous material. The details of the means for introducing the strata, and the like structures, may be as described above.

According to yet another aspect of the invention relates to a method of forming a foam-fiber slurry having a solids consistency of between about 2–25%, utilizing a tank having an at least partially open top, a bottom, and an interior, said method comprising the steps of: (a) Tangentially introducing foam into the tank interior at a plurality of different locations spaced circumferentially around the tank interior, to form at least one vortex in the tank interior. (b) Introducing fibers into the tank through the open top thereof, to flow into the foam vortex and form a fiber/foam slurry having a consistency of between about 2–25%. And (c) pumping the formed slurry out of the tank through the tank bottom. Step (a) may be practiced utilizing 3–5 or more, tangential pipes extending into the tank, and fibers may be added from any suitable conventional conveying structures for fibers, for example, simply falling through the open top of the tank into the tank interior. The fibers may be of any conventional cellulose or non-cellulose configuration and construction, as described in the copending applications mentioned above, and the consistency may be within any narrow range within the 2–25% range set forth above, e.g. between about 3–20%, between about 5–10%, etc. Pumping may be accomplished utilizing a centrifugal pump, or any other conventional type of pump, and pumping may take place directly to a manifold which distributes the fiber/foam slurry to two or more different conduits for utilization of the structures. The foam that is utilized in the practice of step (a) may be foam that is recycled after having been withdrawn during the earlier web formation and/or may include newly created foam.

It is a primary object of the present invention to provide versatile assemblies and methods for employing the foam process of non-woven web formation in order to facilitate a wide variety of web formations. This and other objects of the invention will become clear from an inspection of a detailed description of the invention, and from the appended claims.

DETAILED DESCRIPTION OF THE DRAWINGS

Figure 1:
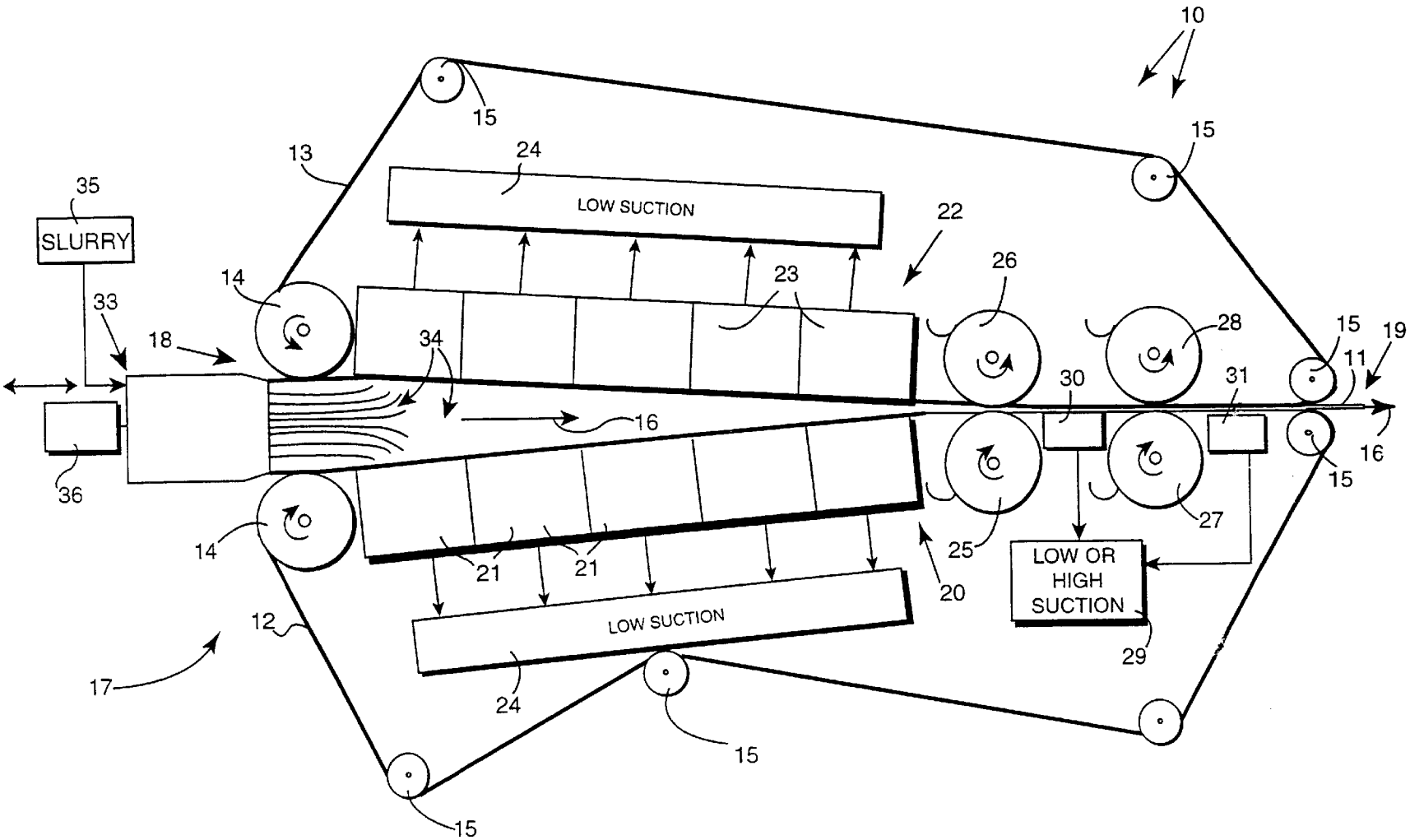
FIG. 1 is a side schematic view showing one exemplary form of an assembly according to the present invention for producing a non-woven web of fibrous material utilizing nip rollers to provide the majority of the energy necessary for web formation.

FIG. 1 schematically illustrates—shown generally by reference numeral 10—a former assembly for producing a non-woven web of fibrous material (e.g. cellulose, glass, or other fibers and/or mixtures thereof—the web being seen schematically at 11 in FIG. 1—using the foam process, according to the present invention. The assembly 10 comprises one or more conventional foraminous elements 12, 13 (two being shown in FIG. 1), also conventionally called a wire. The wires 12, 13 are entirely conventional, and are driven in a loop utilizing conventional drive and idler rollers such as schematically illustrated at 14, 15, respectively, in FIG. 1. Any suitable configuration of rollers or like guiding and powering components being provided depending upon the particular components being utilized. A non-woven fibrous web 11 is formed on the wires 12, 13, while the wires are moving in a first direction 16.

The assembly 10 also comprises a former, shown generally by reference numeral 17, through which the foraminous element(s) 12, 13 moves (move) in the direction 16. The former 17 includes a first foam/fiber slurry introduction end 18 and a second, formed web 11 withdrawing end 19.

The former 17 schematically illustrated in FIG. 1 is one that is designed to use pressure rather than high suction to "dewater" the pulp slurry (that is the slurry of fibers and foam) to form the web 11. In the particular embodiment illustrated a suction table 20, with numerous individual suction compartments 21, is provided associated with the wire 12, while a similar suction table 22, with compartments 23, is associated with the wire 13 (if provided), both in a first section of the former 17. According to the invention the suction tables 20, 22 are connected up to a low suction source 24, that is the source that applies substantially only enough suction to remove foam, and not to effect significant "dewatering" for web formation. The suction (vacuum) applied by the low suction source 24 (which may be any conventional suction source such as a vacuum pump) is less than 100 cm water head, preferably less than 50 cm water head, and desirably about 10 cm water head.

Downstream of the first section of the former 17, containing the suction tables 20, 22, in the first direction 16, is a second section which comprises at least one pair of nip rolls 25, 26. The nip rolls 25, 26 are illustrated in the FIG. 1 exemplary embodiment in association with a second pair of nip rolls 27, 28, although under some circumstances a single pair of nip rolls 25, 26 may be provided, or additional pairs of nip rolls may also be provided. In the embodiment illustrated in FIG. 1 the wires 12,13, as well as the foam/fiber slurry between the wires 12, 13 pass between nip rolls 25, 26, and the nip rolls collectively provide more than 50% of the energy for foam removal to effect formation of the web 11. Typically, the nip rolls 25, 26 and 27, 28 provide more than 90% of the energy, the rest being provided merely by the low suction sources 24, or by the low or high (e.g. over about 1.5 meters water head) section source 29 associated with the suction compartment 30 between the pairs of nip rolls 25, 26 and 27, 28, and/or the suction compartment 31 downstream of the last pair of nip rolls (27, 28). Any conventional drying or like equipment for finishing formation of the web 11 may be provided downstream of the nip rolls 27, 28 in the direction 16.

The suction tables 20, 22 as well as the nip rolls 25–28, and the suction source associated compartments 30–31, may comprise means for removing foam from the slurry to effect formation of the web 11 on the wire(s) (12, 13). One or more of the nip rolls 25–28 may be a suction roller instead of, or in addition to, the suction source 29. The foam removing means preferably are those as described above, but under circumstances other conventional mechanical or suction foam removing components may be provided.

The assembly 10 further comprises means—as shown schematically by reference numeral 33 in FIG. 1—for introducing a foam/fiber slurry into the former 17 first end 18 so that the slurry contacts the wire 12 (e.g. both the wires 12, 13 of the embodiment illustrated in FIG. 1). The slurry introduction means 33 typically introduces a foam-fiber slurry having a solids (fiber) consistency of between about 2–25%, or any range therebetween, and a wide variety of fibers may be utilized including cellulose fibers, and non-cellulose fibers, as well as other materials, as described in the copending applications mentioned above. The means 33 may comprise any conventional foam/fiber slurry introduction structure, such as any suitable conduits, manifolds, plates, headboxes, nozzles, or the like. In the exemplary embodiment illustrated a plurality of plates 34 are schematically illustrated (which may be pivoted at the upstream ends thereof in the direction 16) for providing introduced strata of slurries from one or more sources of slurry 35. Also, a reciprocating means 36 is schematically illustrated in FIG. 1, means 36 comprising a pneumatic or hydraulic cylinder, or any conventional reciprocating element or structure, to move the foam/fiber slurry introducing means 33 toward and away from the first end 18 of the former 17, depending upon the particular products being made, or other parameters.

Figure 2:
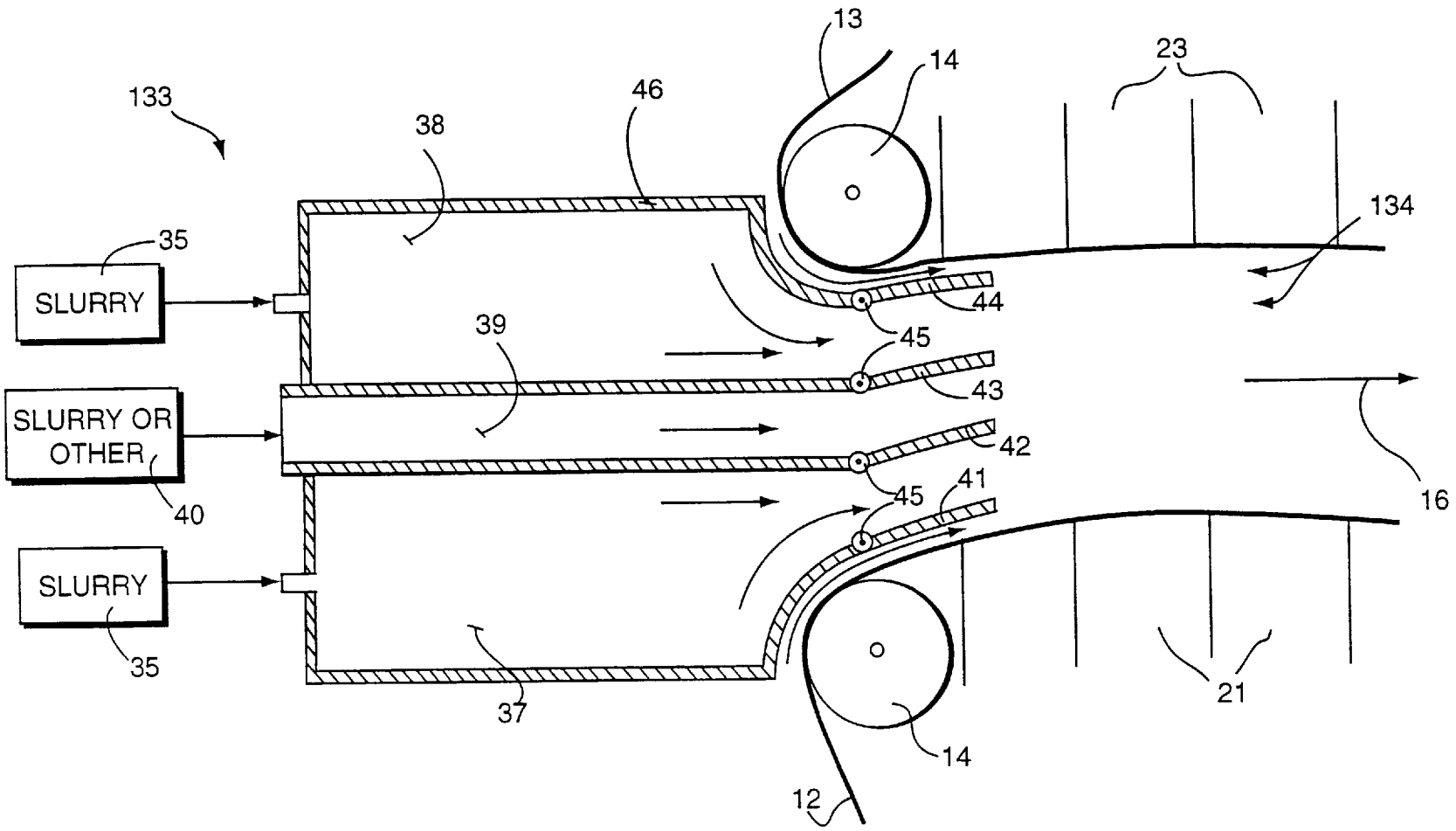
FIG. 2 is a side schematic view, primarily in cross section, of the modification of the former of the apparatus of FIG. 1.

FIG. 2 illustrates in more detail one configuration that the foam introducing means 33—in FIG. 2 illustrated generally and schematically by reference numeral 133—may have for introducing a plurality of strata of foam/fiber slurries, or like materials, for the formation of the web 11. In this embodiment three different strata are being introduced, introduction means 133 being divided into a first compartment 37 which introduces a foam/fiber slurry directly into contact with the wire 12, a second compartment 38 which introduces foam/fiber slurry directly into contact with the wire 13, and an intermediate chamber 39 which introduces foam/fiber slurry, or any other suitable material for formation of the web 11 (such as SAP), between the strata provided by the chambers 37, 38. The chambers 37, 38 may be connected up to the same source of foam/fiber slurry 35—as illustrated in FIG. 2—or two sources of slurry that have different consistencies, fibers, etc. The chamber 39 may be connected up to a source 40 of yet another slurry (having different consistency and/or fibers), or other material such as SAP.

Plates 134 illustrated in FIG. 2 which define channels for various strata may comprise individual plates 41, 42, 43, 44, all of which may be pivoted at the upstream end thereof in the direction 16 (all pivots indicated by the common reference numeral 45) to a main housing 46 for the structure 133. While the pivots 45 may be provided to allow adjustment of the particular dimensions and location of the channels through which the slurries are introduced from the chambers 37 through 39, once the plates 41–44 are moved to a desired position they are held in place by a lock mechanism associated with the pivots 45, or in any conventional manner known in the art (such as for conventional liquid process head boxes). Also, a fail-safe mechanism may be provided or an adjustment limit, to insure that the plates 41, 44 do not come into contact with the wires 12, 13 since the plates 41, 44 typically would be of metal if they contact the wires 12, 13—which are normally of nylon or other synthetic material—significant damage to the wires 12, 13 may result. Alternatively, the plates 42, 43 may be of flexible material (e.g. spring steel) and then need not have a defined pivot 45.

Figure 3:
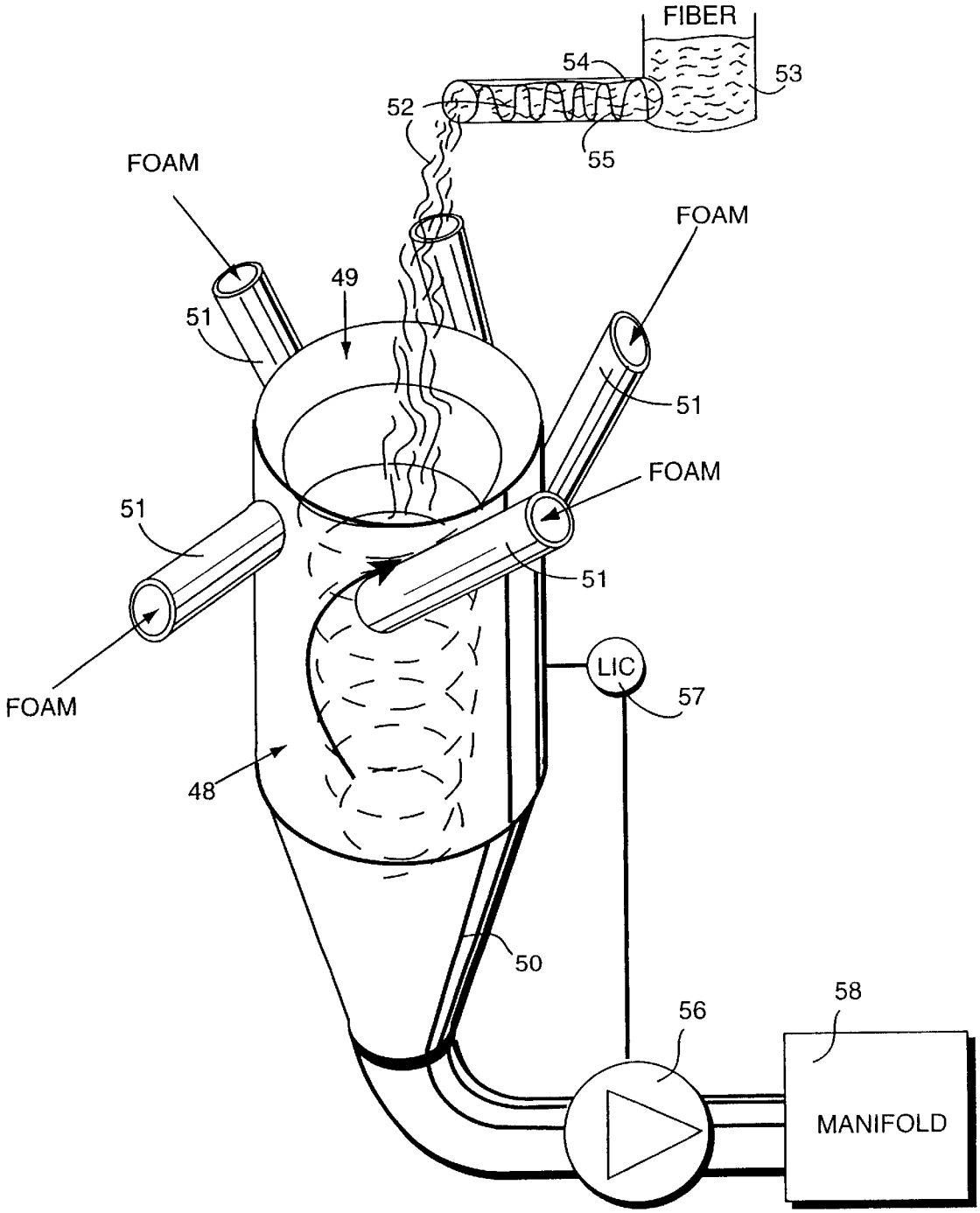
FIG. 3 is a top perspective schematic view of an exemplary fiber/foam slurry mixing assembly according to the present invention for practicing the method of forming a foam-fiber slurry according to the invention.

The source of the slurries 35, 40 may be conventional equipment as illustrated and described in the above identified copending applications and/or may be an apparatus illustrated schematically in FIG. 3. FIG. 3 shows a tank 48 having an at least partially open top 49 (a completely open top is illustrated in FIG. 3), a bottom 50, and a plurality (e.g. 3–5 or more) of tangential foam inlets 51 connected up to any source of foam (such as foam recycled from the suctions 24, 29 in FIG. 1, or sources "new" foam). The tangential inlets 51 establish at least one vortex in the tank 48. Means are provided for adding fiber—shown schematically at 52 in FIG. 3—through the top 49 of the tank 48, to mix with the foam introduced by the inlet/conduits 51 to establish a foam/fiber slurry (typically having a consistency of between 2–25%, or any other range therebetween, depending upon the type of fiber, the density of the foam, and the web 11 desirably produced). The properties of the foam preferably are as described in the above mentioned copending applications. The means for adding the fiber 52 may be any conventional source of fiber, such as a tank 53 with a conduit 54 having a metering screw conveyor 55, or like mechanically driven automatically powered component, therein. The exact nature of the means for adding the fibers is not critical and any suitable conventional construction may be utilized.

Connected to the bottom 50 of the tank 48 is a pump 56, which may be a centrifugal pump, or any other suitable pump construction. The pump 56 is controlled by a conventional LIC 57, and the pump 56 may discharge to a manifold 58 which comprises source of slurry 35. Also, the slurry in the manifold 58 may be provided to other parts of the system, such as described in the above mentioned copending applications.

Figure 4:
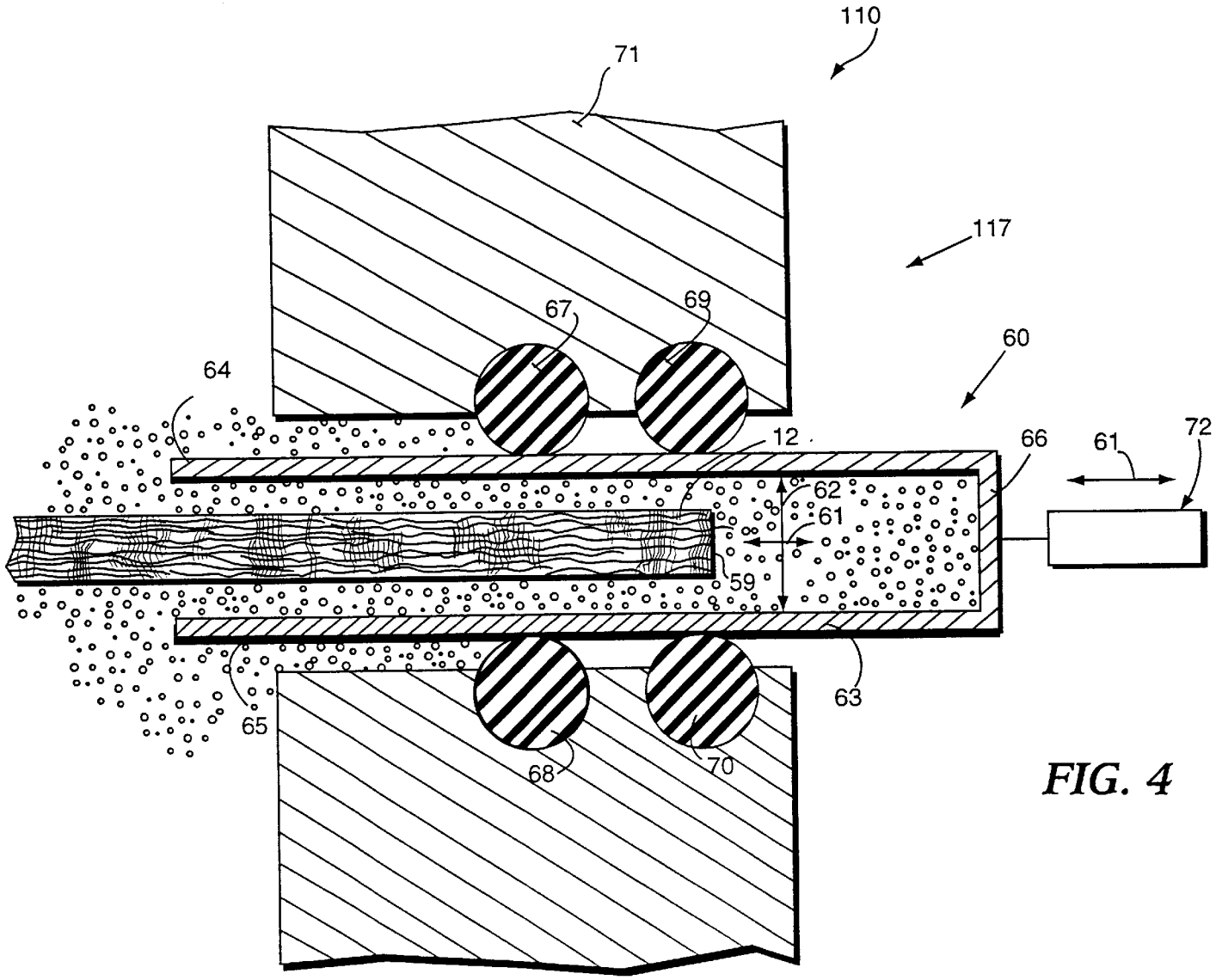
FIG. 4 is a side view, primarily in cross section, of the edge configuration of a former according to the present invention at a first section thereof as seen in FIG. 1.

The wires 12, 13 for the former assembly 10 have side edges substantially parallel to the direction 16. FIG. 4 illustrates details of an edge seal arrangement that may be provided for the first section of the former 17 in FIG. 1, but for simplicity of illustration—and also because the single wire embodiment is clearly feasible within the scope of the invention—an assembly 110 is illustrated in FIG. 4 having only a single wire 12. One of the side edges 59 of the wire 12 is illustrated in FIG. 4, but of course the wire 12 has an opposite side edge too.

An edge seal, shown generally by reference numeral 60, is provided for side edge 59 (and also for the opposite side edge) of the wire 12 which allows some sideways movement of the wire 12 (e.g. see arrow 61 in FIG. 4) in a dimension substantially perpendicular to the first direction 16, and also allows some vertical movement, as indicated by the arrow 62, but does not allow significant slurry leakage from the former 117. The edge seal 60—which is just provided in the first section of the former 117, where a suction table 20, 22 would be—in one exemplary embodiment thereof is illustrated in FIG. 4. It comprises a channel shaped element 63, having a pair of substantially parallel metal side plates (shown at the top and bottom of FIG. 4) 64, 65, spaced from each other (see spacing also indicated by arrow 62) by a crosspiece 66, the spacing (62) being significantly greater than the thickness of the wire 12, and the side plates 64, 65 having outer surfaces (the top surface of the plate 64 and the bottom surface of the plate 65) receiving the wire edge 59 therebetween. Flexible sealing elements such as elastomeric O-rings (which are in linear form, not in annular form, as used in the structure of FIG. 4) 67, 68 are associated with the outer surfaces of the plate 64, 65 and provide a seal therewith. Backup elastomeric sealing elements 69, 70 (any number) may also be provided. The sealing elements 67–70 are mounted to a sidewall 71 of the former 117. A channel 63 thus allows the wire 12 to have movement yet still a very positive seal is provided.

Under some circumstances, especially when changing wires or when a wire of a different width, or the like, is being utilized, or for other functions, it may be necessary to move the channel 63. For this purpose a means 72 may be provided for reciprocating the crosspiece 66 in a dimension (the same dimension 61) perpendicular to the first direction 16, but so that the side plates 64, 65 continue to engage the flexible material seals 67–70. The reciprocating means 72 may comprise any conventional structure capable of automatically reciprocating the channel 63, such as a pneumatic or hydraulic cylinder, an electric motor, hand operated mechanical components, or the like. The side plates 64 have a length (in the dimension direction 61) greater than the expected length of travel of the reciprocating means 72 in the dimension 61, so that the plates 64, 65 always engage the seals 67–70.

If necessary or desirable substantially pure foam injection may be provided in the volume defined between the side plates 64, 65 and the crosspiece 66 in order to effect good sealing, or for other desirable qualities. If foam injection is utilized, it may be provided by any suitable conventional structure for that purpose.

Figure 5:
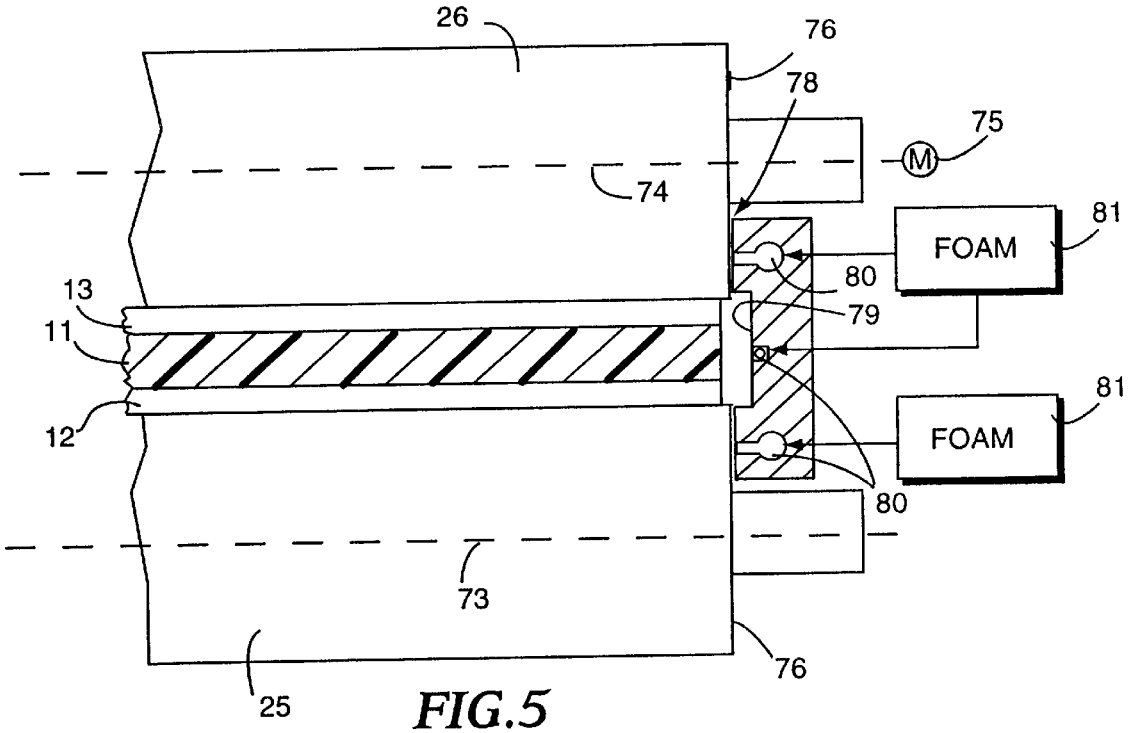
FIG. 5 is a longitudinal cross sectional view, partly in elevation showing an edge seal at the nip rollers of the assembly of FIG. 1.
Figure 6:
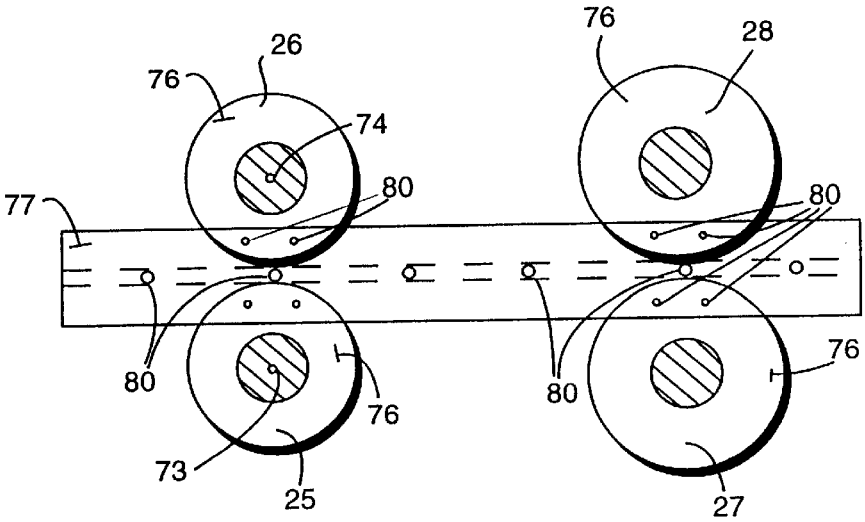
FIG. 6 is an end view of the rollers, with edge seal configuration, of FIG. 5 as utilized in the assembly of FIG. 1.

FIGS. 5 and 6 schematically illustrate a second form of edge seal associated with the assembly 10 of FIG. 1, in this case with the second section of the assembly 10, that is where the nip rolls 24–28 are provided. FIG. 5 illustrates simply the nip rolls 25, 26, all of which are powered for rotation about substantially horizontal axes 73, 74, respectively (e.g. by a conventional motor 75), which axes 73, 74 are substantially parallel to each other and substantially transverse to the first direction 16. The nip rolls 25, 26 have side faces, collectively indicated by reference numeral 76. In the second section, the edge seal is provided by a preferably plastic (or like synthetic material) plate 77 adjacent each of the side edges of the wire or wires 12, 13 and associated integral side faces 76, and having a space—indicated schematically by reference numeral 78 (in FIG. 5) therebetween. A channel 79 may be provided in the plate 77 adjacent the wires 12, 13 and the web 11, to provide a wider area than the space 78.

As most clearly seen in FIG. 5, but also schematically illustrated by the structures 80 in FIG. 6, foam introducing means are provided for introducing substantially fiber-free foam into the spaces 78 (on both sides of the rollers/wires) so that substantially fiber-free foam substantially fills the spaces 78 (and the channel 79) to provide an effective seal. Foam introduction means 80 communicate with a source of foam 81 under pressure. The foam injection components 80, 81 are illustrated only schematically in FIGS. 5 and 6 because any suitable structures may be provided for the foam introduction including any desired nozzles, conduits, pumps, manifolds, or like fluidic components.

Figure 7:
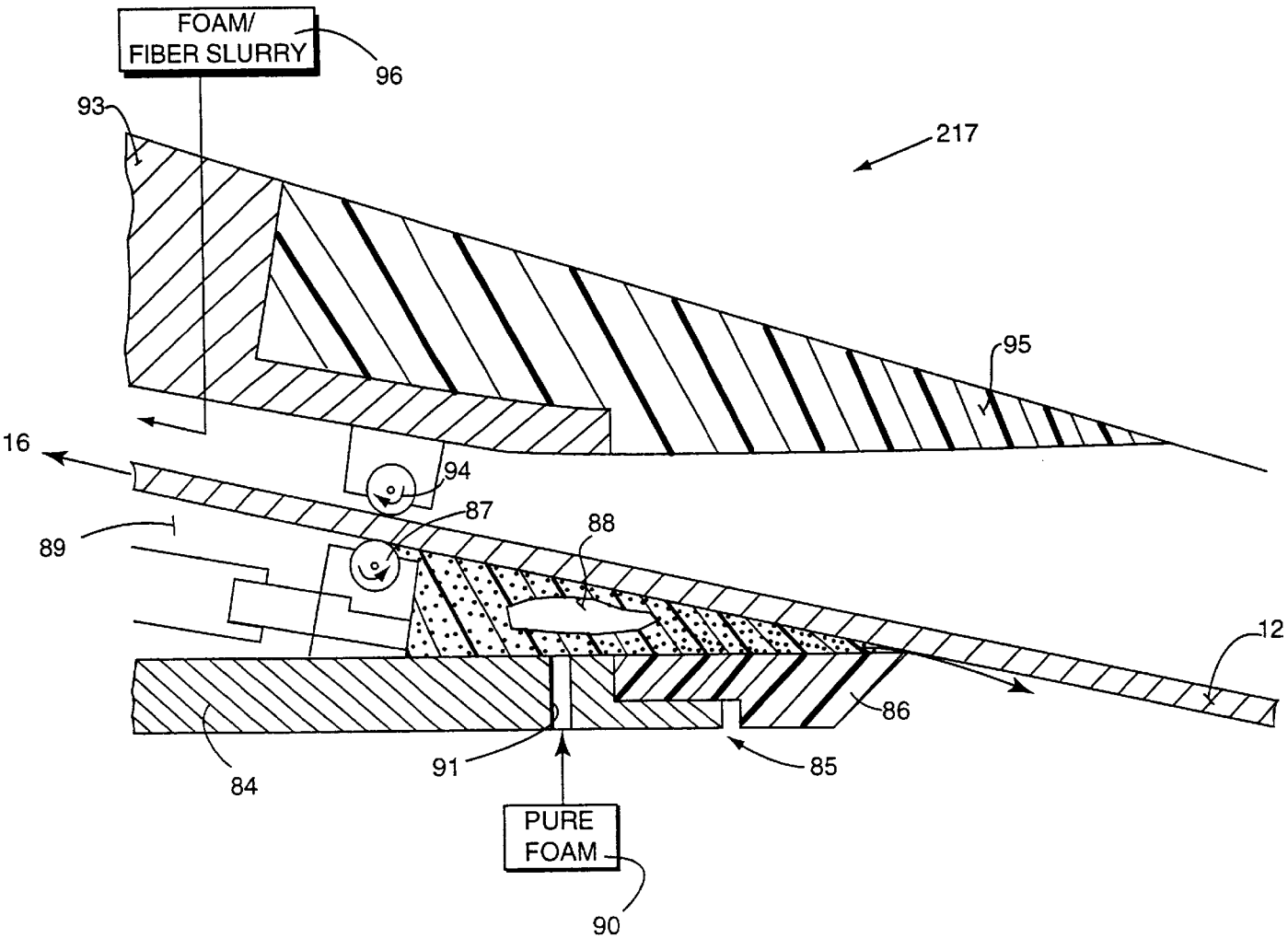
FIG. 7 is a side view, primarily in cross section, of an alternative inlet configuration for a former according to the present invention.

FIG. 7 schematically illustrates another exemplary structure that may be used in a former assembly for producing a non-woven web of fibrous material, according to the present invention. The structure illustrated in FIG. 7 is an alternative inlet configuration to a former having an alternative configuration to that illustrated in FIG. 1. For this particular configuration, the former—shown schematically and generally by reference numeral 217 in FIG. 7—comprises a pivoted metal plate 84 having a free end 85 with a rubber or plastic (or like synthetic material) end portion 86 comprising or covering free end 85 of the pivoted plate 84. The plate 84 is pivoted (at a location not shown) remote from the free end 85, and is pivoted for adjustment purposes, that is typically held in a position to which it is moved. The wire 12 moves in that direction 16 past the end portion 86, may engage end portion 86 since the end portion 86 is made of a material that will not easily destroy the wire 12 and in view of the foam leakages which will be hereinafter described.

The former 217 also includes a roller or fixed seal 87 adjacent the free end 85 of the plate 84 and engaging the wire 12, a volume 88 being defined between the free end 85 and the roller seal 87. According to the invention means are provided for injecting substantially fiber-free foam, from source 89, into the volume 88 at a pressure that is greater than the pressure within the former as indicated by the volume 89 (that is a pressure greater than the volume 89 on the opposite side of the seal 87 from the end portion 86). The pure foam will then have a tendency to leak out of the volume 88, providing lubrication between the moving wire 12 and the end portion 86, and if there is any leakage associated with the volume 89 it will be foam leaking into the volume 89 past the rubber seal 87. The means for injecting the foam from source 90 are merely schematically illustrated by the conduit 91 in FIG. 7, but the foam injection means may comprise any conventional structure for that purpose, such as conventional nozzles, manifolds, etc.

The former 217 illustrated in FIG. 7 may also comprise metal plate 93 (which may be stationary, or flexible, or pivoted) which also preferably has a roller or fixed seal 94 associated therewith engaging the wire 12 opposite the seal 87. The plate 93 also may comprise an end portion 95 which is of or covered by rubber, plastic, or like material that will not destroy the wire 12 if it engages it. The fiber/foam slurry may be injected into the volume 89, for coming into contact with the wire 12 for the formation of the web 11 thereon, by any suitable conventional structure, illustrated only schematically at 96 in FIG. 7.

Any suitable additional or conventional complementary structures may be associated with the structures illustrated in FIGS. 1–7, and the structures illustrated in FIGS. 1 through 7 may be utilized to practice a wide variety of methods which comprise or facilitate non-woven web production. For example, the suction sources 24, 29 may be connected up to a cyclone or the like for separating excess air from the foam before recycling, the metal plates 42, 43 of the introduction means 133 of FIG. 2 may merely be of flexible material rather than pivoted, where adjustment mechanisms are utilized elongated holes in which adjusting screws are provided may be utilized, webs 11 may be produced having a weight of 200 gm/m$^2$ up to 500 gm/m$^2$ or up to many kg/m$^2$, the tank 48 and pump 56 may be positioned with respect to the other components so that there is only an elapsed time of about 3–5 seconds from introduction of the fiber 52 into the tank 48 until the foam/fiber slurry is fed into the former 17, and the dwell time in the tank 48 is only about 1 second. The controller 57 may be responsive to the rpm of the pump 56, or to the feed rate.

A wide variety of parameters may be utilized for the various systems and components of the assembly and method according to the invention, primarily as described in the above mentioned copending applications. When SAP is utilized in the production of the web 11, a higher web speed than would otherwise be provided is desired, the normal range of web speed being about 50–500 m/minute. Ion exchange resins, activated carbon, etc., in fact virtually any filler, may be utilized in place of or in addition to SAP. All of the flow systems are preferably designed so that there are no dead spots where foam can collect.

It will thus be seen that according to the present invention a versatile and desirable assembly and method are provided for producing the non-woven webs of fibrous material using the foam process. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A former assembly for producing a non-woven web of fibrous material comprising:

a foraminous element on which a non-woven fibrous web may be formed moving in a first direction;

a former through which said foraminous element moves in the first direction, said former including a first foam/fiber slurry introduction end and a second formed web withdrawing end;

means for introducing a foam/fiber slurry into said former first end so that the slurry contacts said foraminous element;

means for removing foam from the slurry to effect formation of a web on said foraminous element;

wherein said foraminous element has side edges substantially parallel to the first direction;

an edge seal for each of said side edges of said foraminous element which allows some sideways movement of said foraminous element, in a dimension substantially perpendicular to the first direction, but does not allow significant leakage of slurry from said former; and means for introducing substantially fiber free foam into said edge seal at at least some portions thereof for providing lubrication and to assist in preventing leakage of fiber-containing slurry from said former.

2. An assembly as recited in claim 1 wherein said former comprises a first section adjacent said first end including a suction table, and a second section adjacent said second end and comprising at least one set of nip rollers; and wherein said edge seal comprises a first edge seal at said first section and a second edge seal at said second section.

3. An assembly as recited in claim 2 wherein said nip rolls have side faces; and wherein said second edge seal comprises a plastic plate adjacent each side edge of said foraminous element and associated nip roll side faces; and having a space formed therebetween; and wherein said foam introducing means introduces substantially fiber free foam into said spaces so that substantially fiber free foam substantially fills said spaces.

4. An assembly as recited in claim 2 wherein said foam removing means comprises said suction table and said nip rolls, and wherein said nip rolls provide more than 50% of the energy for foam removal to effect web formation.

5. An assembly as recited in claim 4 wherein said second section comprises at least two pairs of nip rolls, with a suction device between said two pairs of nip rolls for carrying away foam removed by said nip rolls.

6. An assembly as recited in claim 4 wherein at least one of said nip rolls comprises a suction roll, for carrying away foam removed by said nip rolls.

7. An assembly as recited in claim 2 wherein said first seal comprises a channel shaped element having a pair of substantially parallel metal side plates spaced from each other by a cross-piece; said side plates having outer surfaces receiving a said foraminous element edge therebetween and spaced from said foraminous element; and flexible material sealing elements stationarily mounted to said former and engaging said side plate outer surfaces to provide a seal therewith.

8. An assembly as recited in claim 7 further comprising means for reciprocating said cross-piece in a dimension substantially perpendicular to the first direction, but so that said side plates continue to engage said flexible material seals, said side plates having a length greater than the length of travel of said reciprocating means.

9. An assembly as recited in claim 4 wherein said foam introducing means introduces substantially fiber free foam only into said second section of said edge seal, not said first section.

10. An assembly as recited in claim 2 further comprising means for carrying foam removed by said foam removing means away from said removing means and to a device for mixing with additional fibers to produce a foam—fiber slurry.

11. An assembly as recited in claim 10 wherein said device for mixing foam with additional fibers comprises a tank having a top, bottom, and a plurality of tangential foam inlets for establishing at least one vortex in said tank; means for adding fiber through said top of said tank; and a foam-fiber slurry pump connected to said bottom of said tank.

12. An assembly as recited in claim 1 wherein said former further comprises a pivoted metal plate past which said foraminous element moves, said plate having a free end and a roller seal adjacent said free end and engaging said foraminous element, a volume defined between said free end and said rollerseal; and means for injecting substantially fiber free foam into said volume between said free end and said roller seal under a pressure greater than the pressure in said former on the opposite side of said roller seal from said free end.

13. An assembly as recited in claim 12 wherein said former further comprises a rubber or plastic end portion comprising or covering said free end of said pivoted plate.

14. An assembly as recited in claim 13 further comprising a second metal plate spaced from said pivoted metal plate, said second metal plate also having a free end; a second roller seal spaced from said free end of said second plate and engaging said foraminous element; and a rubber or plastic end portion comprising or covering said second plate free end.

15. An assembly as recited in claim 1 further comprising means for introducing at least two different strata into said former at said first end thereof, a first of said strata comprising a fiber/foam slurry having first properties, and a second of said strata comprising a fiber/foam slurry having second properties significantly different from said first properties, or another material capable of incorporation into a web of fibrous material.

16. An assembly as recited in claim 15 further comprising means for reciprocating said strata introducing means toward and away from said former first end.

17. An assembly as recited in claim 16 wherein said strata introducing means comprises at least one metal plate having a pivoted end most remote from said former first end, and a free end closest to said former first end, said free end having no metal portion touching said foraminous element.

18. An assembly as recited in claim 17 wherein said foraminous element comprises a first foraminous element; and further comprising a second foraminous element moving generally parallel to said first foraminous element; and wherein said strata introducing means comprises a second pivotal plate, and means for introducing at least three different strata into said former first end, first and third strata in contact with said first and second foraminous elements, respectively, and a second strata between said first and third strata which is precluded from contacting said foraminous elements.

19. An assembly as recited in claim 18 wherein said means for removing foam from said slurry comprises suction tables cooperating with said first and second foraminous elements adjacent said first end of said former, said tables applying a vacuum of less than 100 cm water head so as to only remove excess foam from said slurry.

20. An assembly as recited in claim 19 further comprising at least one set of nip rollers downstream of said suction tables, said nip rollers applying the majority of the force necessary for forming the web from the slurry.

21. A former assembly for producing a non-woven web of fibrous material comprising:

a foraminous element on which a non-woven fibrous web may be formed moving in a first direction;

a former through which said foraminous element moves in the first direction, said former including a first foam/fiber slurry introduction end and a second formed web withdrawing end;

means for introducing a foam/fiber slurry into said former first end so that the slurry contacts the foraminous element;

means for removing foam from the slurry to effect formation of a web on said foraminous element; and wherein said former further comprises a pivoted metal plate past which said foraminous element moves, said plate having a free end and a roller seal adjacent said free end and engaging said foraminous element, a volume defined between said free end and said roller seal; and means for injecting substantially fiber free foam into said volume between said free end and said roller seal under a pressure greater than the pressure in said former on the opposite side of said roller seal from said free end.

22. An assembly as recited in claim 21 wherein said former further comprises a rubber or plastic end portion comprising or covering said free end of said pivoted plate.

23. An assembly as recited in claim 22 further comprising a second metal plate spaced from said pivoted metal plate, said second metal plate also having a free end; a second roller seal spaced from said free end of said second plate and engaging said foraminous element; and a rubber or plastic end portion comprising or covering said second plate free end.

24. A former assembly for producing a non-woven web of fibrous material comprising:

a foraminous element on which a non-woven fibrous web may be formed moving in a first direction;

a former through which said foraminous element moves in the first direction, said former including a first foam/fiber slurry introduction end and a second formed web withdrawing end;

means for introducing a foam/fiber slurry into said former first end so that the slurry contacts the foraminous element;

means for removing foam from the slurry to effect formation of a web on said foraminous element; and means for introducing at least two different strata into said former at said first end thereof, a first of said strata comprising a fiber/foam slurry having first properties, and a second of said strata comprising a fiber/foam slurry having second properties significantly different from said first properties, or another material capable of incorporation into a web of fibrous material.

25. An assembly as recited in claim 24 further comprising means for reciprocating said strata introducing means toward and away from said former first end.

26. An assembly as recited in claim 25 wherein said strata introducing means comprises at least one metal plate having a pivoted end most remote from said former first end, and a free end closest to said former first end, said free end having no metal portion touching said foraminous element.

27. An assembly as recited in claim 26 wherein said foraminous element comprises a first foraminous element; and further comprising a second foraminous element moving generally parallel to said first foraminous element; and wherein said strata introducing means comprises a second pivotal plate, and means for introducing at least three different strata into said former first end, first and second strata in contact with said first and second foraminous elements, respectively, and a third strata between said first and second strata which is precluded from contacting said foraminous elements.

28. An assembly as recited in claim 27 wherein said means for removing foam from said slurry comprises suction tables cooperating with said first and second foraminous elements adjacent said first end of said former, said tables applying less than about 100 cm head so as to only remove excess foam from said slurry.

29. An assembly as recited in claim 28 further comprising at least one set of nip rollers downstream of said suction tables, said nip rollers applying the majority of the force necessary for forming the web from the slurry.

* * * * *